United States Patent [19]

Carmody

[11] 4,356,867

[45] Nov. 2, 1982

[54] TEMPORARY LOCK-OPEN TOOL FOR SUBTERRANEAN WELL VALVE

[75] Inventor: Michael A. Carmody, Broken Arrow, Okla.

[73] Assignee: Baker International Corporation, Orange, Calif.

[21] Appl. No.: 306,047

[22] Filed: Sep. 28, 1981

Related U.S. Application Data

[63] Continuation-in-part of Ser. No. 232,473, Feb. 9, 1981.

[51] Int. Cl.[3] ..... E21B 34/06

[52] U.S. Cl. ..... 166/373; 166/237; 166/323; 166/334

[58] Field of Search ..... 166/373, 323, 322, 321, 166/152, 143, 148, 142, 128, 334, 325, 237, 238

[56] References Cited

U.S. PATENT DOCUMENTS

| | | | |
|---|---|---|---|
| 2,447,842 | 8/1948 | Carcron | 166/323 |
| 3,045,752 | 7/1962 | Keithahn | 166/237 |
| 3,207,222 | 9/1965 | Tamplen | 166/237 |
| 3,387,659 | 6/1968 | Currell | 166/237 |
| 3,786,865 | 1/1974 | Tausch | 166/323 |
| 3,888,306 | 6/1975 | Wetzel | 166/237 |
| 4,088,298 | 5/1978 | Brown | 166/339 |

*Primary Examiner*—William F. Pate, III

*Attorney, Agent, or Firm*—Robert W. Pitts; William C. Norvell, Jr.

[57] ABSTRACT

A method and an apparatus for setting the temporary lock-open mechanism incorporated in a safety valve employed in the subterranean well, the apparatus including an annular mandrel having an external, axially movable, radially expandable collet operated by an axially movable prong concentrically arranged within the mandrel housing.

The temporary lock-open mechanism of the valve includes latch fingers which are adapted to engage the end of a plunger which opens the valve, a spring biased lock-open sleeve and release keys for holding the sleeve in a passive position.

The valve is temporarily locked in an open position by introducing control line pressure into the valve for opening it and moving its lock-open mechanism to a position where the expandable collet of the apparatus can release keys that restrain the lock-open sleeve. The control line pressure is then bled off, thus allowing the spring biased lock-open sleeve to move to a position for camming the latch fingers into engagement with the end of the valve opening plunger.

14 Claims, 12 Drawing Figures

TEMPORARY LOCK-OPEN TOOL FOR SUBTERRANEAN WELL VALVE

CROSS-REFERENCE TO RELATED APPLICATION

This application is a continuation-in-part of co-pending application Ser. No. 232,473, filed Feb. 9, 1981, and assigned to the assignee of the present application.

BACKGROUND OF THE INVENTION

1. Field of the Invention

The invention relates to a tool for actuating the temporary lock-open mechanism of a safety valve adapted for downhole use in a subterranean well.

2. Description of the Prior Art

Safety valves, e.g. flappers, responsive to a pressure signal or wire line control are known in the art. A typical normally closed valve is held open during production by a plunger responsive to a fluid pressure control signal from the surface. When the control pressure is reduced, the plunger retracts, permitting the valve to close. It is often desirable for such a valve to have a releasable temporary lock-open feature, whereby the valve may be mechanically latched open without the necessity for a continuous pressure signal. Wire line equipment may then be run through the valve without danger of the valve being closed against such equipment.

In known types of tools three or four trips are required to set the temporary lock-open mechanism and then retrieve the tool which, of course, takes up wire line time and requires an inventory of many different types of tools. Accordingly, it is desirable to produce a lock-open tool which has the capability of engaging and actuating the temporary lock-open mechanism of the safety valve in one trip into the well, and being retrievable by wire line thereafter.

SUMMARY OF THE INVENTION

The invention relates to a safety valve, which may be tubing mounted having a releasable temporary lock-open mechanism located below the valve head.

An annular housing contains the valve, for instance a flapper valve having a valve head pivotally retractable into a side pocket. The flapper head is hinge mounted and biased by a torsion spring to a closed position. Above the valve, an annular plunger is disposed within the housing, and is downwardly shiftable to push open the valve. The plunger is spring biased upwardly by a helical power spring for the closed valve position. An annular piston secured to and disposed above the plunger defines part of a pressure chamber, to which a fluid pressure signal from the surface is applied. Sufficient pressure will move the piston and plunger downwardly against the biases of the aforementioned springs, pushing open the valve. Hence, the valve will remain in the open position so long as the control pressure is maintained, and will return to a closed position when the pressure is reduced.

A temporary lock-open mechanism is disposed within the housing, below the valve. In the valve open position, the plunger extends through the annular valve seat and below the valve, adjacent the lock-open mechanism. When actuated, the lock-open mechanism releasably engages the lower end of the plunger, thus preventing its upward retraction, even if control pressure is reduced, thereby locking the valve open.

The lock mechanism comprises an annular, axially shiftable sleeve, at the top of which is mounted a plurality of circumferentially spaced, upwardly extending latch fingers. The upper ends of the latch fingers include heads adapted to engage an annular groove formed in the outside cylindrical surface of the plunger. The inside surface of the housing tapers upwardly and inwardly above the latch fingers, whereby the latch fingers are cammed inwardly into tight engagement with the annular groove when the sleeve and fingers are shifted upwardly.

The lock sleeve is spring biased to the upper locking position, but is normally retained in a lower position by a plurality of circumferentially spaced release keys linking the locking sleeve to a lower, annular release key mandrel. The keys and mandrel may be manipulated by a wire line tool to release the keys and actuate the lock. Then the keys are released, the sleeve is urged upwardly by the spring bias, and the latch fingers are cammed into engagement with the groove formed in the plunger. The lock-open mechanism may be reset to its normal unlocked position by a downward movement of the plunger in response to increased control pressure.

In the event of a valve failure, the safety valve may be permanently locked open, and a second, surface controlled, flapper safety valve may be run into the housing to replace the locked open valve. Therefore, the safety valve assembly also includes a permanent lock-open lock mechanism disposed above the safety valve. The permanent lock-open mechanism includes an annular locking mandrel above the piston. With a wire line controlled tool, the mandrel may be shifted downwardly to contact the piston. As the mandrel is shifted further, the piston and plunger move downwardly, thereby opening the valve. At this point, a resilient collet carried by the mandrel expands outwardly and underneath an inwardly projecting shoulder of the housing, thereby preventing retraction of the mandrel and the reclosing of the valve.

A lock releasing tool constructed in accordance with this invention includes an annular hollow mandrel having a spring biased plunger mounted on the outer surface of the mandrel which is longitudinally movable from a spring pressed "cocked" position to an operating position where it affects the expansion and downward movement of the fingers of a collet to set the mechanism of the safety valve. An internally disposed longitudinally movable slide member concentrically arranged with the mandrel and secured to a running tool, operates retractable means which releases the spring pressed plunger which then moves along the mandrel to expand and actually shift the collet fingers.

DESCRIPTION OF THE PREFERRED EMBODIMENT

Figure 1B:
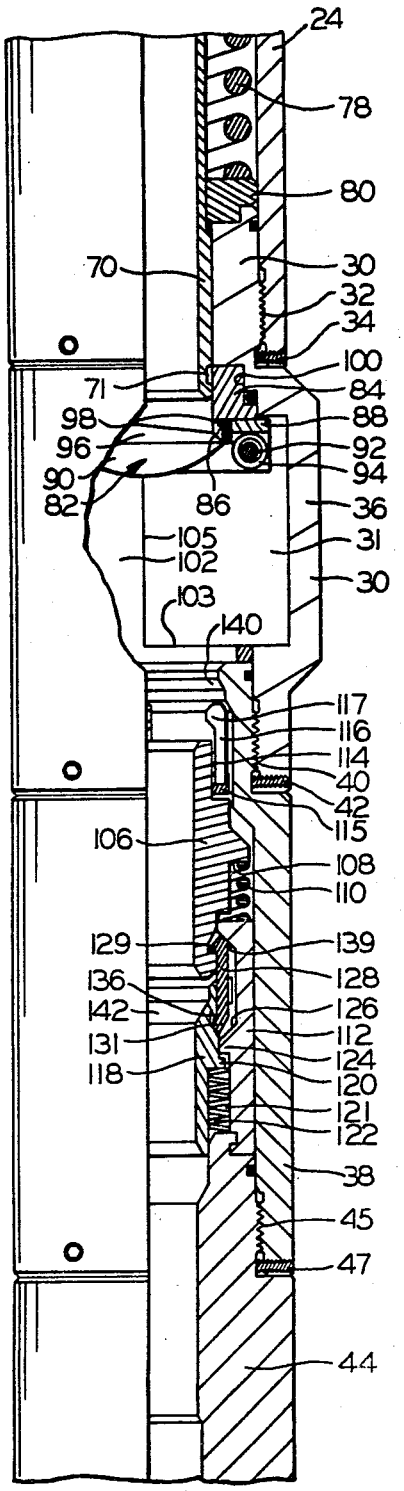
FIGS. 1*a* and 1*b* are elevational views, partly in section, of a valve assembly embodying the invention, the valve assembly illustrated in a normally closed configuration, FIG. 1*b* being a lower continuation of FIG. 1*a*.
Figure 1A:
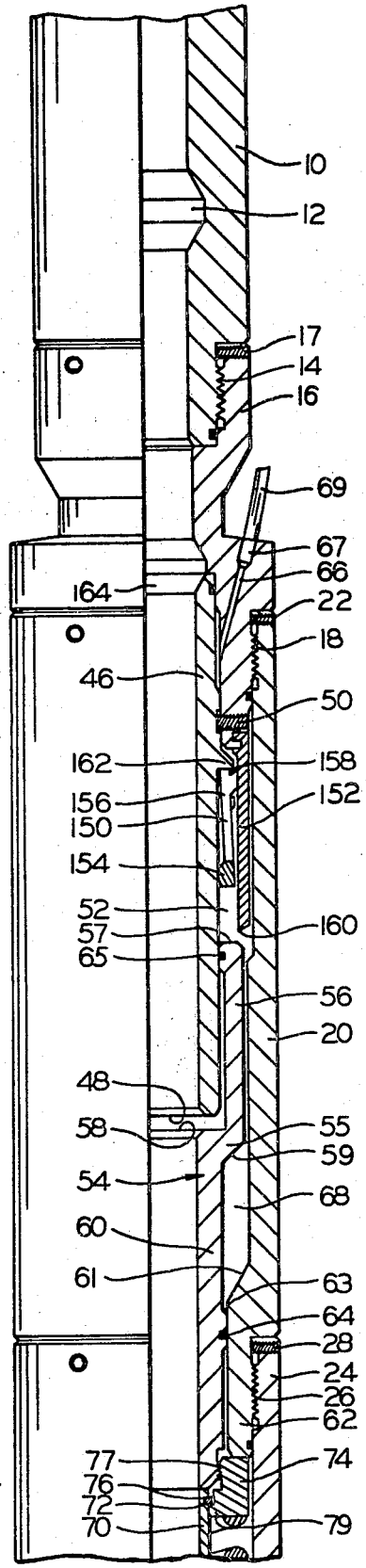

Referring to FIGS. 1*a* and 1*b*, the safety valve assembly includes a top nipple adapter 10, which would typically be threadably secured to the lower end of a tubing string (not illustrated). The nipple adapter 10 includes an internal landing groove 12, in which a second safety valve may be landed by conventional techniques, in the event of the failure of the primary safety valve 82, to be later described. The nipple adapter 10 is attached by means of threads 14 to a top sub 16. The provision of the nipple adapter 10 as a component separable from the top sub 16 permits ready substitution of different nipple adapters, when the valve assembly is to be made up to accomodate differing seal bore sizes or threads. The threaded connection of the nipple adapter 10 to the top sub 16 is secured by radial set screws 17 above the threads 14.

The top sub 16 is attached be a threaded connection 18 to an annular upper housing 20. The threaded connection 18 also includes radial set screws 22. The upper housing 20 is secured at its lower end to an annular outer housing 24 by means of a threaded connection 26 and set screws 28. An annular valve housing 30 is secured to the lower end of the outer housing 24 by means of a threaded cnnection 32 and set screws 34. The valve housing includes an outwardly projecting side pocket 36, formed to accomodate the flapper valve head 90 in an interior valve chamber 31. Below the projecting side pocket 36, the valve housing 30 is connected to a temporary lock-open housing 38 through a threaded connection 40 and radial set screws 42. A bottom sub 44 is connected to the lower end of the temporary lock-open housing 38 by a threaded connection 45 and set screws 47.

The valve 82 and lock-open mechanisms are disposed within the annular housing defined by the top sub 16, the outer housing 24, the valve housing 30, the temporary lock-open housing 38, and the bottom sub 44.

An annular locking mandrel 46 (FIG. 1*a*) is secured to the inside surface of the top sub 16 by a radial shear pin 50. The locking mandrel 46 has a smaller outside diameter than the inside diameter of the outer housing 24. Therefore, the outer housing 24 and the locking mandrel 46 define between them an annular chamber 52.

An axially shiftable annular piston 54 is provided which includes an upper 56 having a top surface 57 disposed in the annular chamber 52 between the locking mandrel 46 and the outer housing 24. Below the bottom annular surface 48 of the locking mandrel 46, the piston 54 includes an integral cross over section 55 having an upwardly facing shoulder 58 spaced below the bottom surface 48 of the locking mandrel 46, and a downwardly facing shoulder 59. The cross over section 55 provides a transition from the upper piston portion 56 to a lower piston section 60 which has inside and outside diameters approximately equal to those of the locking mandrel 46.

Above the threaded connection 26, the inner surface of the outer housing 24 tapers inwardly as at 61 to a reduced inside diameter portion 62 having an inside diameter slightly larger than the outside diameter of the lower piston 60. An elastomeric O-ring 64 carried by the lower piston section 60 forms a sliding seal against the inside surface 62 of the outer housing 24. The lower piston section 60 includes an upwardly facing annular surface 63 above the O-ring 64. An elastomeric O-ring 65 carried by the inner surface of the upper section 56 of the piston 54 forms a sliding seal against the outside surface of the locking mandrel 46. A pressure chamber 68 is thereby defined between the O-rings 64 and 65, including the annular chamber 52 between the locking mandrel 46 and the outer housing 24, and the annular chamber 68 between the lower section 60 of the piston 54 and the outer housing 24. The chamber 68 includes the upwardly facing shoulders 57 and 63 and the downwardly facing surface 59 of the piston 54. These surfaces 57, 59 and 63 are so proportioned that fluid pressure within the chamber 58 exerts a net downward force on the piston 54.

The chamber 68 is in fluid communication with a conduit 66 formed in the top sub 16, and having a threaded port 67. A flexible conduit 69 is attached to the port 67 and extends upwardly alongside the nipple adapter 10 and the tubing string (not illustrated) to the surface. Typically, the conduit 69 is banded to the tubing string.

An annular plunger 70 is secured to the lower end of the piston 54 by means of a split ring 72 and a piston coupling nut 74. During assembly of the piston 54 and plunger 70, the split ring 72 is snapped into an annular groove 76 formed in the outside cylindrical surface of the plunger 70. The piston coupling nut 74 is attached to the piston 54 by means of a threaded connection 77. An inwardly projecting flange 79 of the piston coupling nut 74 underlies the split ring 72, thus maintaining the plunger 70 and piston 54 is attached relationship. The lower end of the plunger 70 includes an annular groove 71 (FIG. 1*b*) formed in its outside cylindrical surface.

The plunger 70 extends downwardly into the valve housing 30 within the annular space between the plunger 70 and the outer housing 24 a helical power spring 78 extends between the piston coupling nut 74 and a lower annular spring stop 80. The spring 78 thus exerts an upward bias on the piston 54 and plunger 70, urging them to the position shown in FIG. 1*a*. The spring stop 80 also acts as a bearing and alignment member for axial sliding movement of the plunger 70.

As mentioned, the safety valve 82 is disposed within the valve housing 30. Although the particular valve illustrated and described is a hinged flapper valve, any known valve actuatable by axial movement of a plunger 70 could be employed. The valve 82 comprises an annular valve seat 84 having a conical sealing surface 86. The valve 82 also comprises a valve base 88, to which the flapper valve head 90 is hingedly secured. The hinged attachment of the valve head 90 to the valve base 88 comprises a hinge pin 92 and a torsion spring 94 which biases the valve head 90 to the closed position illustrated in FIG. 1, in a conventional manner. The valve head 90 includes a conical sealing surface 96 adapted to form a seal against the complementary sealing surface 86 of the valve seat 84. The sealing surfaces 96 and 86 are precision machined, to provide a high pressure, metal-to-metal seal. A secondary, low pressure seal is formed by the contact of the valve head 90 with an elastomeric sealing ring 98 which is held between the valve seat 84 and the valve base 88.

Figure 2B:
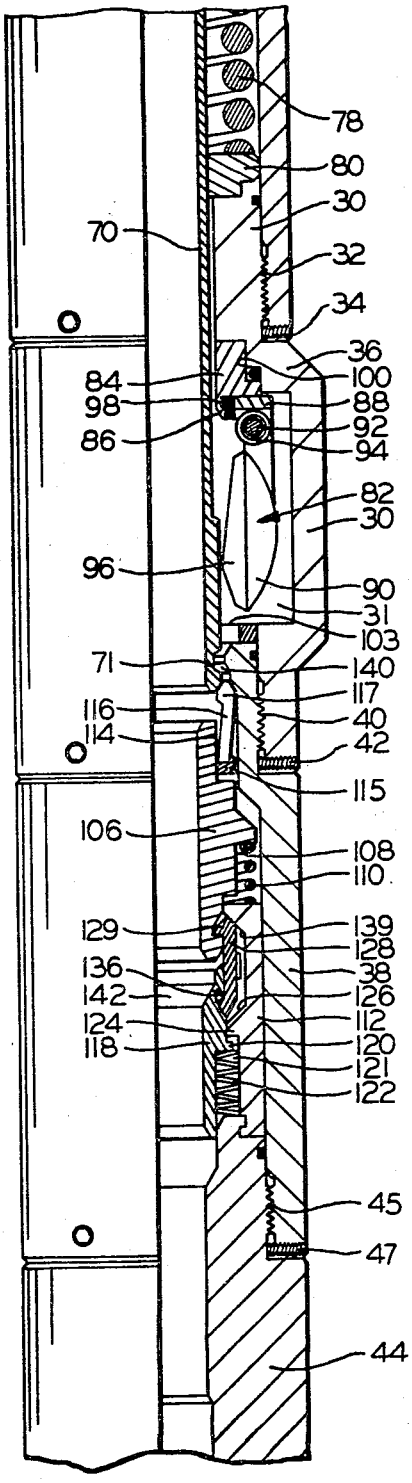
FIGS. 2*a* and 2*b* are elevational views, partly in section, similar to FIGS. 1*a* and 1*b*, but with the valve assembly in a valve open position, maintained by a continuous fluid pressure signal from the surface.

During assembly of the valve 82, the valve seat 84 is placed coaxially relative to the plunger 70, against the complementary upper surface 100 of the valve chamber 31. The valve base 88 the elastomeric sealing ring 98, the valve head 90, and the hinge pin 92 are assembled into place, and supported by the valve support member 102. The valve support member 102 includes a lower ring 103 defining the lower limit of the valve chamber 31, and an upwardly extending, integral, cylindrical segment 105 which contacts the valve base 88. As illustrated in FIG. 1*b*, the entire valve assembly is held in assembled position when the temporary lock-open housing 38 is threadably attached to the valve housing 30. The upper surface of the temporary lock-open housing 38 abuts the ring portion 103 of the valve support member 102 and presses the cylindrical segment 105 tightly against the valve base 88. The cylindrical support segment 105 is oriented opposite the side pocket 36, providing a free path for the valve head 90 to pivot into the open position illustrated in FIG. 2*b*.

A temporary lock-open mechanism is disposed within the temporary lock-open housing 38, below the valve housing 30. The temporary lock-open mechanism comprises an annular, axially shiftable temporary lock-open sleeve 106. The temporary lock-open sleeve 106 includes an outwardly projecting, downwardly facing shoulder 108 providing an upper spring stop for a helical temporary lock-open spring 110. The lower end of the spring 110 rests on the upper surface of a temporary lock-open cage 112, which is secured to, and extends upwardly from the bottom sub 44, within the lock-open housing 18. The spring 110 biases the temporary lock-open sleeve 106 upwardly towards the position illustrated in FIG. 3.

An annular recess 114 is formed in the outside cylindrical surface of the lock-open sleeve 106, adjacent the top of the lock-open sleeve 106. A plurality of resilient, axially extending, circumferentially spaced latch fingers 116 are disposed in the recess 114, the extend upwardly therefrom. The latch fingers 116 are interconnected by an integral annular base 115. The upper ends of the latch fingers 116 include enlarged heads 117 adapted to engage the aforementioned groove 71 of the plunger 70.

An annular temporary lock-open mandrel 118 is slidably mounted within the lock-open cage 112, below the lock-open sleeve 106. The lock-open mandrel 118 includes an outwardly projecting, annular flange 120. Below the flange 120, the outer surface of the lock-open mandrel 118 is inwardly recessed, thereby providing an annular space 121 between the lock-open mandrel 118 and the lock-open cage 112. A plurality of annular, resilient, Belleville springs or washers 122 are stacked within the annular space 121 between the top of the bottom sub 37 and the flange 120. The Belleville washers 122 exert an upward bias on the lock-open mandrel 118. The engagement of the flange 120 with a flange 124 inwardly projecting from the lock-open cage 112 limits the upward movement of the lock-open mandrel 118. The flange 124 includes an outwardly and upwardly tapering upper shoulder 126.

A plurality of circumferentially space release keys 128 extend axially between the temporary lock-open sleeve 106 and the temporary lock-open mandrel 118, in the annular space between the lock-open cage 112, and the lock-open sleeve 106 and lock-open mandrel 118. The release keys 128 link the lock-open sleeve 106 and lock-open mandrel 118, holding the lock-open sleeve 106 down against the upward bias of the spring 110. Each release key 128 includes enlarge upper and lower heads 129 and 131 respectively. The upper head 129 of each release key 128 includes a downwardly facing shoulder which engages an upwardly facing annular latch surface 123 on the lock-open sleeve 106. Similarly the lower head 131 of each release key 128 includes an upwardly facing shoulder which engages an inclined downwwardly facing annular latch shoulder 136 on the lock-open mandrel 118. The latch surface 136 tapers inwardly and upwardly. In the position illustrated in FIG. 1*b*, the upper heads 129 of the release keys 128 are prevented from swinging outwardly from engagement with the latch surface 132 by interference with the inclined downwardly facing annular latch shoulder 139 on the lock-open cage 112.

Figure 2A:
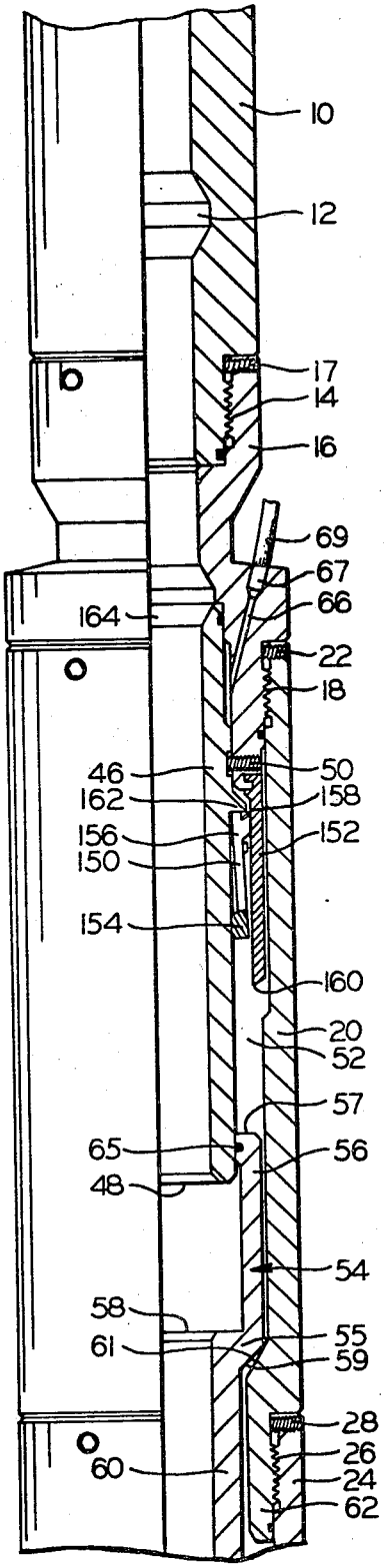

In FIGS. 1*a* and 1*b*, the valve assembly is illustrated in a normally closed position. When a fluid pressure signal of sufficient magnitude is applied to the pressure chamber 68 through the conduit 69 from the well surface, the assembly shifts to the position illustrated in FIGS. 2*a* and 2*b*. The differential areas of the piston 54 are so proportioned that pressure within the chamber 68 exerts a net downward force on the piston 54, moving it downwardly against the bias of the power string 78. The valve head 88 is then pivoted downwardly by the plunger 70 on the hinge pin 92, into its retracted position within the side pocket 36. Production fluid can then flow unimpeded through the bore of the annular plunger 70. So long as the pressure control signal from the surface is maintained, the valve assembly will remain in this position, with the plunger 70 preventing the reclosing of the valve 82.

Figure 3:
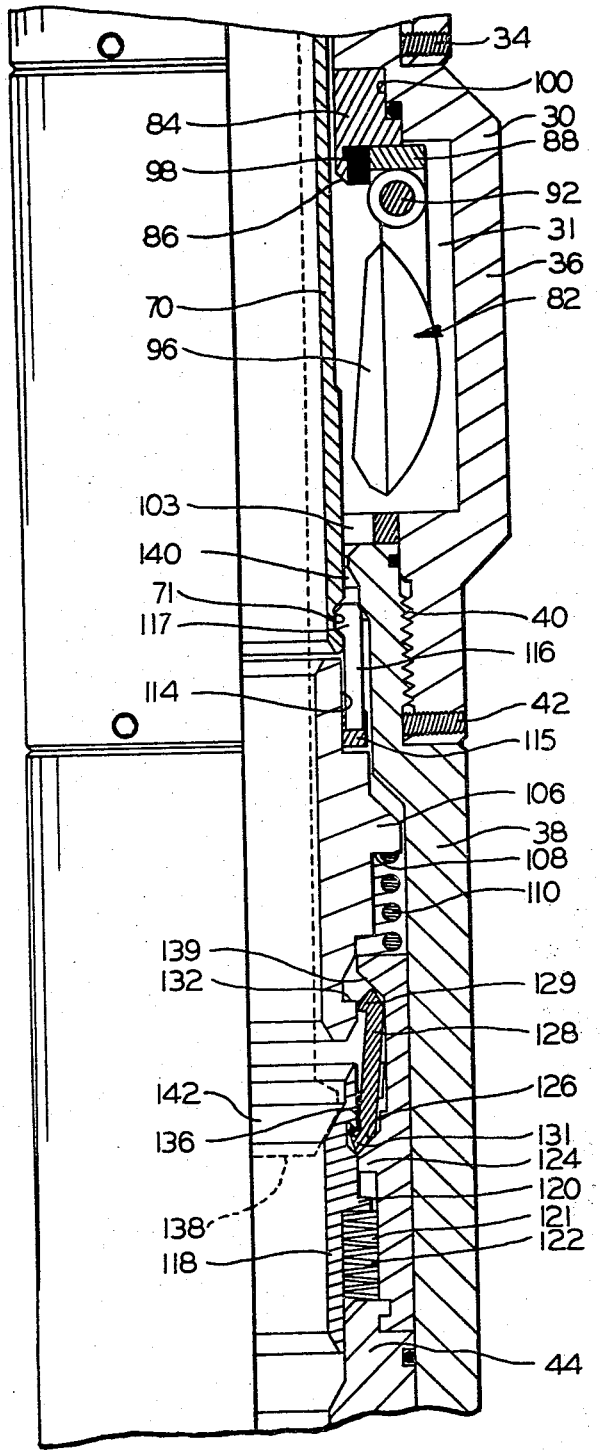
FIG. 3 is an enlarged scale elevational view, partly in section, similar to FIG. 2*b*, illustrating the actuation of the temporary lock-open mechanism by a wire line tool.
Figure 5A:
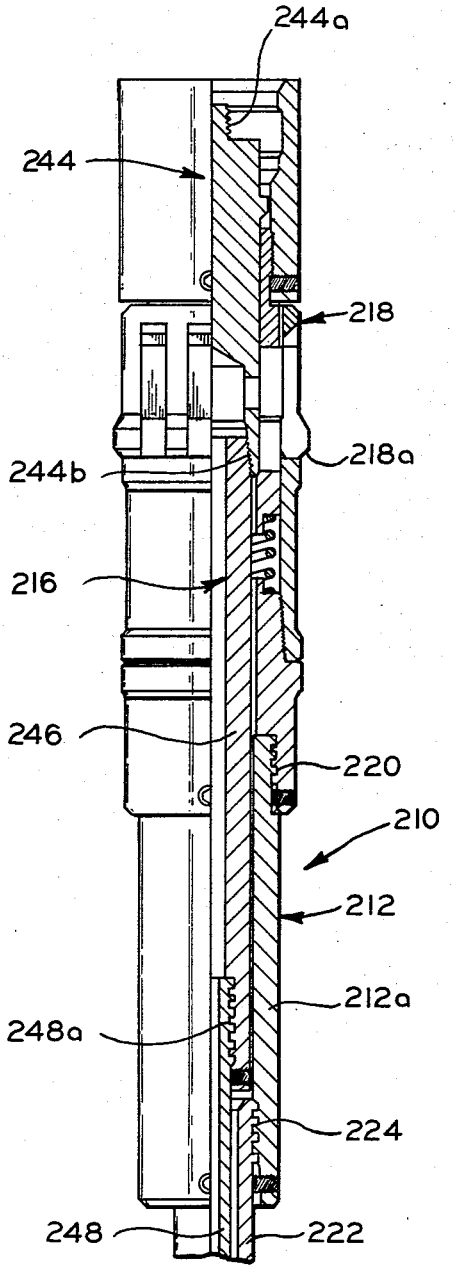
FIGS. 5*a* and 5*b* are elevational views, partly in section of a lock-open tool embodying this invention and illustrating the tool in a "cocked" position, FIG. 5*b* being a lower continuation of FIG. 5*a*.
Figure 5B:
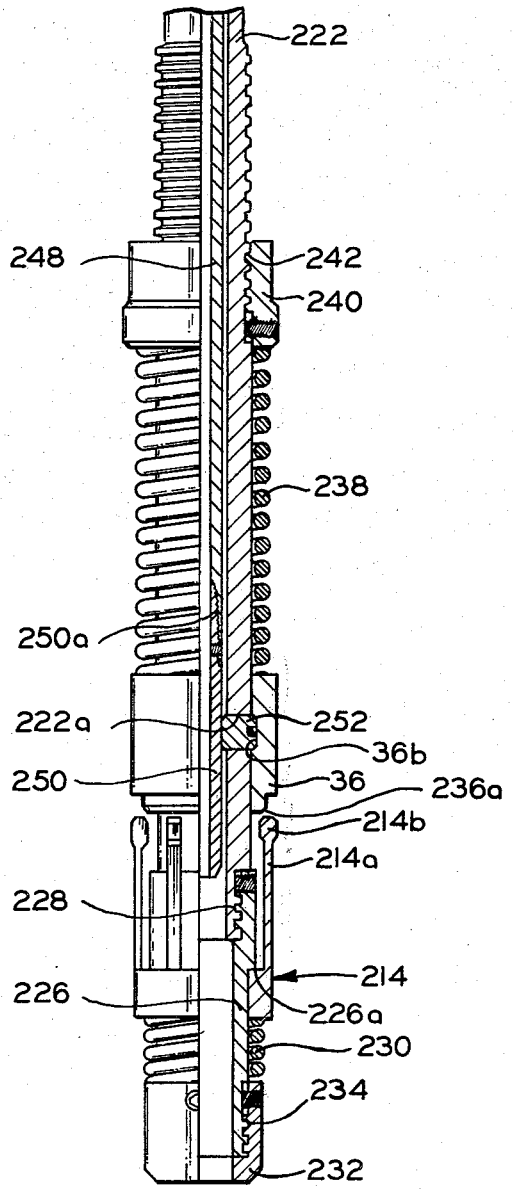

In some situations, it may be desirable to temporarily lock the valve 82 open. As illustrated in FIG. 3, this may be done by means of a wire line tool 138 (illustrated in phantom line in FIG. 3) inserted through the piston 54, the plunger 70 and the valve seat 84. Preferably, a wire line tool 210, illustrated in FIGS. 5*a* and 5*b* is employed to temporarily lock the valve 82 open. Normally, the temporary lock-open sleeve 106 and the lock-open mandrel 118 are linked together by the release keys 128. The lock-open sleeve 106 is thereby retained downwardly against the bias of the spring 110. The latch fingers 116 are therefore not in a position to engage the annular groove 71 formed in the plunger 70. The lock-open tool 138 or 210 releases the lock-open sleeve 106 for upward movement as will be described hereinafter.

The temporary lock-open tool 138 includes a lower flange adapted to engage an upwardly facing shoulder 142 on the lock-open mandrel 118.

The temporary lock-open tool 210 illustrated in FIGS. 5*a* and 5*b* includes an outer tubular mandrel assembly 212 having a valve lock-open mechanism actuating collet 214 longitudinally movably mounted thereon, and an axially movable annular side assembly 216 concentrically disposed within the outer mandrel assembly 212 which actuates means for expanding a plurality of fingers 214*a* extending longitudinally from the collet 214.

More specifically, as illustrated in FIGS. 5*a* and 5*b*, the outer mandrel assembly 212 includes a landing sub-assembly 218 which is threadably secured as at 220 to a top end of a mandrel body 212*a*. A power spring mandrel 222 threadably secured at 224 to the bottom end of the mandrel body 212*a* and a lower extension sleeve 226 which is threadably secured as at 228 to the bottom end of the power spring mandrel 222.

A shiftable member, such as collet 214 is longitudinally movably mounted on the outer surface of the lower extension sleeve 226 between a downwardly facing shoulder 226*a* and a damping spring 230. The damping spring 230 surrounds the lower extension 226 and extends between the bottom surface of the collet 214 and an end cap 232 threadably secured as at 234 to the bottom end of the lower extension sleeve 226. Each collet finger 214*a* is provided with an enlarged head 214*b* which can be expanded radially outwardly by the lower formed end 236*a* of a plunger 236. The plunger 236 is longitudinally movably mounted on the outer surface of the power spring mandrel 222 and is movable from a first or "cocked" position (see FIG. 5*b*) by a compressed power spring 238 extending between the upper end of the plunger 236 and a longitudinally adjustably mounted collar 240 threadably secured as at 242 to the power spring mandrel 222, to a second or actuating position (see FIG. 7) to expand the collet fingers 214*a* outwardly.

The slide assembly 216 comprises an annular probe member 244 adapted to be connected to a conventional running tool (not shown) by threads 244*a* on the top end of the probe member 244 is adapted to be threadably connected as at 244*b* to the upper end of a slide body 246. A slide extension 248 is threadably connected as at 248*a* to the lower end of a slide body 246. A stinger 250 is threadably connected as at 250*a* to the lower end of the slide extension 248. The outer surface of this stinger 250 expands a plurality of lock segments 252, which are mounted in radial apertures 222*a* provided in the power spring mandrel 222 radially outwardly for lockingly engaging a groove 236*b* provided in the inner wall of the plunger 236.

To actuate the temporary lock, with the wire line operated lock-open tool 138, the lock-open mandrel 118 is pushed downwardly by the tool 138, against the bias of the Belleville washers 122.

Figure 7:
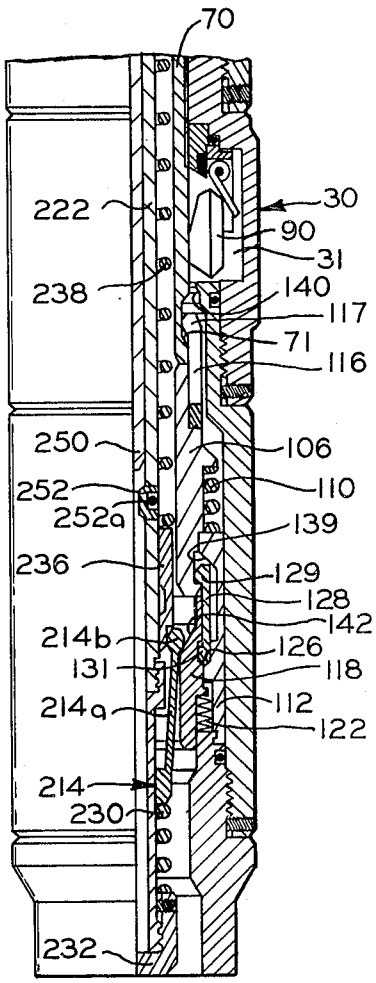
Figure 6:
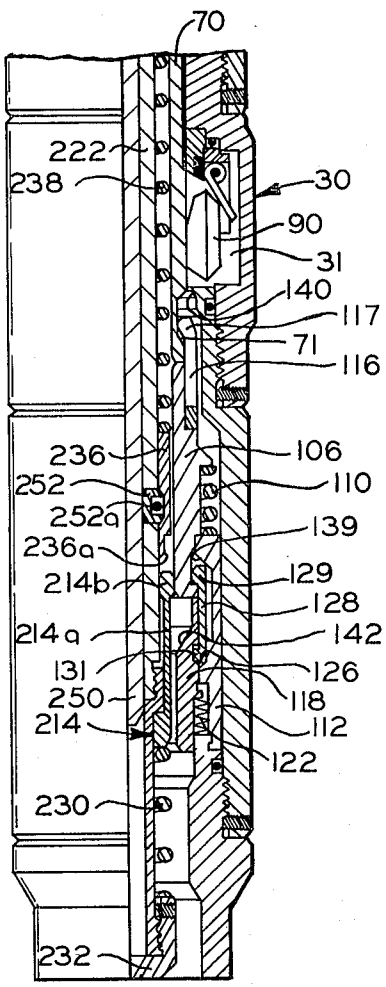

To actuate the temporary lock with the wire line operated tool 210, the lock-open mandrel 118 is pushed downwardly by the heads 214*b* of the collet fingers 214*a* engaging the upwardly facing shoulder 142 on the lock open mandrel 118 (FIG. 7).

Figure 9:
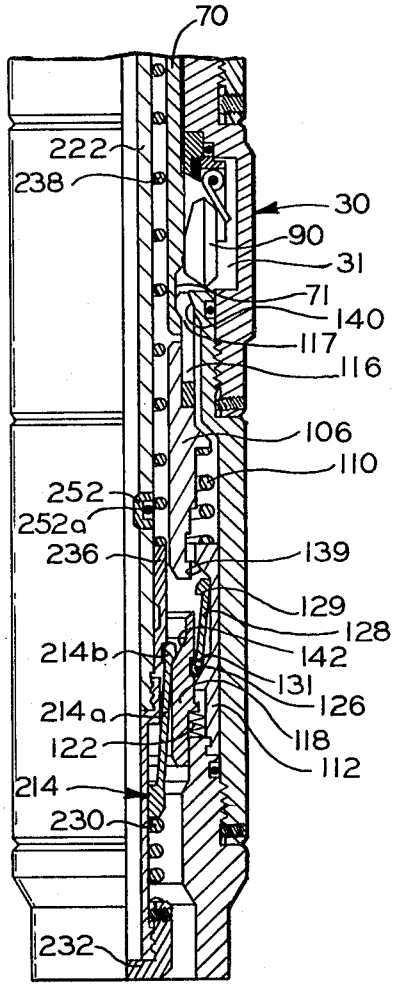
FIGS. 6, 7, 8 and 9 are fragmentary, elevational views partly in section and similar to FIG. 3, illustrating the successive positions of the temporary lock-open mechanism of the safety valve effected by the lock-open tool illustrated in FIGS. 5*a* and 5*b*.

More specifically, the lock-open tool 210 is run through the valve 82 by conventional techniques until the segment shoulders 218*a* on the landing assembly 218 lands in the internal landing groove 12 (FIG. 1*a*) of the top nipple adapter 10. Then, the conventional running tool is sheared from the top portion of the locking tool 210 so that it may be retrieved by the tubing string. As the running tool is retrieved, so also will be the slide assembly 216 of the locking tool 210 as it is attached at 244*a* (see FIG. 5*a*) to the running tool. As the finger 250 is moved from beneath the lock segment 252 as illustrated in FIG. 7, a garter spring or O-ring 252*a* causes the lock segments 252 to retract radially inwardly, thus releasing the plunger 236 which then moves downwardly to its second position. Concurrently, the formed end 236*a* on the plunger 236 engages and expands the finger heads 214*b* on the collet 214 causing the heads 214*b* to engage the internal shoulder 142 on the lock-open mandrel 118 and move the mandrel 118 axially downwardly (see FIG. 9) against the bias of the Belleville washers 122.

The lock-open mandrel 118 in turn pulls the release keys 128 downwardly, by engagement of the latch surface 136 of the lock-open mandrel 118 and the lower heads 131 of the release keys 128. After the release keys 128 have shifted downwardly, the upper heads 129 of the release keys 218 are no longer in contact with the downwardly facing shoulder 139 of the lock-open cage 112, and are thus free to shift outwardly. As the lock-open mandrel 118 and the release keys continued to move downwardly, the lower heads 131 of the release keys 128 come into contact with the upwardly facing, inwardly tapering shoulder 126 of the lock-open cage 112. The shoulder 126 cams the lower heads 131 of the release keys 128 inwardly, causing the release keys 128 to pivot on the outer circular edge of the latch surface 136 as a fulcrum. The release keys 128 are thus pivoted to the position illustrated in FIG. 3 for the tool 138 and FIGS. 8 and 9 for the tool 210, and no longer link together the lock-open mandrel 118 and the lock-open sleeve 106.

Figure 8:
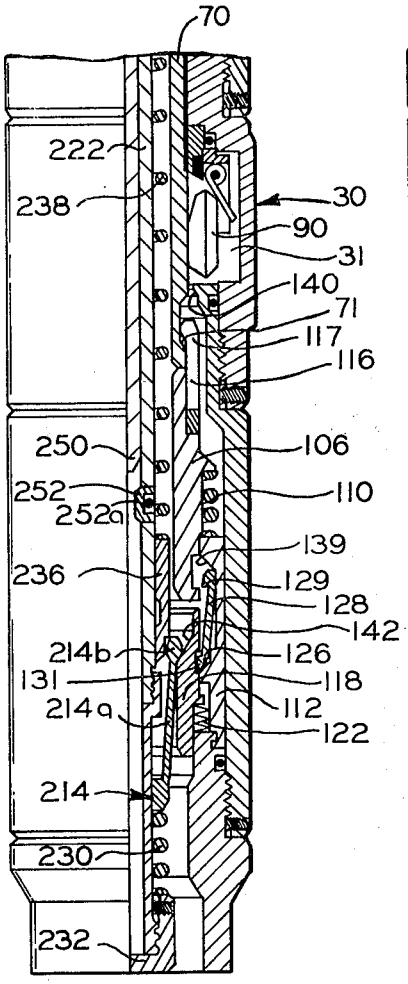

However, as the release keys 128 are pivoted to the position shown in FIG. 8, the lock-open sleeve 106 is still being held in a stationary position by the annular plunger 70. At this point, the control line pressure is bled off from the valve assembly 82 thus allowing the plunger 70 to move upwardly along with the lock-open sleeve 106. At this point the outer mandrel assembly 212 of the lock-open tool 120 can be retrieved from the valve 82 by a conventional retrieving tool.

It should be noted that as the outer mandrel assembly 212 moves upwardly the heads 214*b* of the fingers 214*a* will engage an internal chamfer on the bottom end of the lock-open sleeve 106. The collet 214 then moves downwardly against the bias of the spring 230 thus permitting the heads 214*b* to move out of engagement with the formed end 236*a* on the plunger 236. As the heads 214*b* are disengaged from the formed plunger end 236*a* they are cammed radially inwardly by the chamfer thus permitting the mandrel 212 to be retrieved from the internal bore of the valve 82.

The lock-open sleeve 106 is thus released to move upwardly under the urging of the spring 110. The lock-open sleeve 106 carries upwardly with it the latch fingers 116 disposed within the recess 114. As the resilient latch fingers 116 move upwardly, the heads 117 spread around the outside cylindrical surface of the plunger 70 and continue to move upwardly until they engage an inwardly and upwardly tapering camming surface 140 of the temporary lock-open housing 38. The heads 117 are cammed into tight engagement with the annular groove 71 formed in the outside cylindrical surface of the plunger 70. When the lock-open tool 138 is removed, the valve assembly remains in a lock-open position. The upwardly directed force exerted on the plunger 70 and the latch fingers 116 by the power spring 78 increases the radially inward force exerted on the latch finger heads 117 by the camming surface 140. A secure, locking engagement of the latch fingers 116 within the groove 71 is thereby assured. The valve assembly is thereby temporarily mechanically locked open without the necessity for maintaining a continuous pressure in the pressure chamber 68.

The temporary lock may be unlocked, and the valve 82 reopened, by applying additional pressure through the conduit 69 to the pressure chamber 68. The plunger 70 will move downwardly as described above, forcing the lock-open sleeve 106 downwardly. The bottom of the lock-open sleeve 106 will contact the top heads 129 of the release keys 128 and begin to push the release keys 128 downwardly. Because the lock-open mandrel 118 and the release keys 128 are no longer held downwardly by a lock-open tool 138, they continue to be urged upwardly by the Belleville washers 122 toward the latched position illustrated in FIG. 1*b*. Therefore, when the lock-open sleeve 106 has moved downwardly to allow sufficient clearance, the upper heads 219 of the release keys 128 re-engage the groove defined by the latch surface 132 on the lock-open sleeve 106. The release keys 128 are again retained in this position by the upward bias of the Belleville washers 122 and by the camming surface 139 of the lock-open cage 112. After the lock-open sleeve 106 is thereby returned and latched into the lower position, the plunger 70 is free to retract upwardly by reduction of pressure in the chamber 68, without interference from the latch fingers 116.

Figure 4:
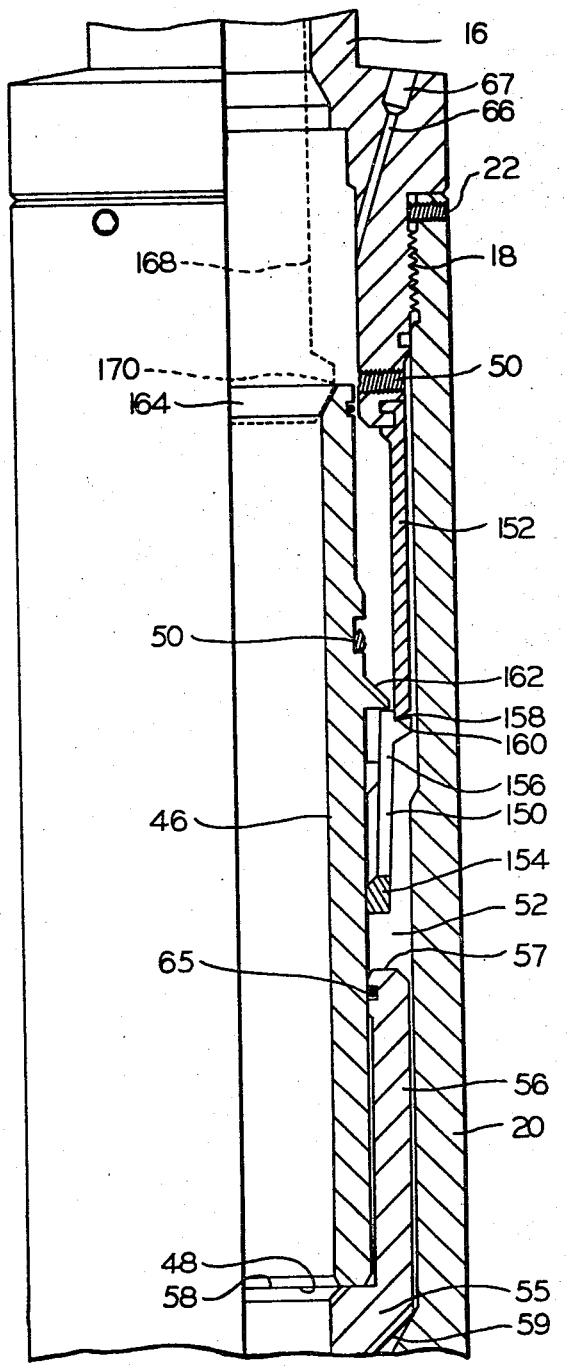
FIG. 4 is an enlarged elevational view, partly in section, of the upper portion of the valve assembly embodying the invention, illustrating the operation of the permanent lock-open mechanism.

In the event of a malfunction of the valve 82, it may be permanently locked open by the permanent lock-open mechanism illustrated in an actuated position in FIG. 4. The permanent lock-open mechanism comprises the permanent locking sleeve mandrel 46, an upper lock collet 150, and an annular upper cage 152. The upper lock collet 150 includes an annular base 154 surrounding the permanent locking mandrel 46, within the annular space 52. A plurality of axial, resilient latch keys 156 extend upwardly from the annular base 154, an upwardly opening notch 158 is formed at the top of each latch key 156. The annular upper cage 152 surrounds the upper lock collet 150. The upper cage 152 is secured to the top sub 16, and is disposed concentrically between the permanent locking mandrel 46 and the outer housing 24. The resilient latch keys 156 are biased radially outwardly but are normally restrained against outward expansion by the inside cylindrical surface of the upper cage 152. The lower end of the upper cage 152 provides a circular edge 160 adapted to engage the the notches 158 in the latch keys 156. The locking mandrel 46 includes an outwardly projecting annular should 162 above the latch keys 156. The upper end of the permanent locking mandrel 46 comprises an upwardly and outwardly tapering surface 164. In the closed valve position illustrated in FIG. 1*a*, the surface 164 and the inner surface of the top sub 16 define a tool recess.

When it is desired to permanently lock the valve 82 in an open position, a wire line controlled, permanent lock-open tool 168 (illustrated in phantom line in FIG. 4) is landed in the tool landing recess defined by surface 164. The permanent lock-open tool 168 includes a lower flange 170 expandable radially to contact the upper surface 164 of the permanent lock-open mandrel 46. The permanent lock-open tool 168 is then jarred downwardly until the shear pin 50 shears, thereby releasing the permanent locking mandrel 46 for downward movement to the permanent lock open position illustrated in FIG. 4. As the permanent lock-open tool 168 and the permanent locking mandrel 46 are moved downwardly, the lower surface 48 of teh permanent lock-open mandrel 46 contacts the upper surface 58 of the piston 54, and thereby pushes the piston 54 and plunger 70 to the valve open position. As the permanent locking mandrel 46 moves downwardly, the annular shoulder 162 engages the tops of the latch keys 156, thereby forcing the upper lock collet 150 downwardly. As the latch keys 156 move below the lower end of the upper cage 152, the latch keys 156 spring outwardly forcing the notches 158 into engagement with the lower edge 160 of the upper cage 152, thereby preventing return of the upper collet 150 to its original position. When the permanent lock-open tool 168 is removed, the annular base 154 of the upper lock collet 150 interferes with upward movement of the piston 54 urged by the upward bias of the power spring 78. The valve assembly is thus in a permanently locked open position.

The valve assembly described provides a reliable tubing mounted safety valve having a lock mechanism. The provision of the temporary lock-open mechanism within the lock-open housing 38 below the valve 32 offer several advantages. The lock-open mechanism is independent of the pressure-controlled operation of the plunger 70, increasing overall reliability of the valve asembly. Because the temporary lock-open mechanism is separate from the valve 82 and plunger 70, there is little chance of damage to the temporary lock-open mechanism in the even the valve 82 is slammed closed. Furthermore, if the user requires no lock-open mechanism, the lock-open housing 38 including the associated lock-open mechanism can be replaced by an appropriate simple bottom sub. The permanent lock-open feature provides additional flexibility to the user.

Although the invention has been described in terms of specified embodiments which are set forth in detail, it should be understood that this is by illustration only and that the invention is not necessarily limited thereto, since alternative embodiments and operation techniques will become apparent to those skilled in the art in view of the disclosure. Accordingly, modifications are contemplated which can be made without departing from the spirit and of the described invention.

What is claimed and desired to be secured by Letters Patent is:

1. A method for temporarily mechanically locking a valve mounted in a tubular conduit of a subterranean well in an open position relative to the conduit, the valve having an actuating sleeve coaxially shiftably mounted in the conduit, latching means engagable with one end of the actuating sleeve in its valve opening position and shiftable latch restraining means normally preventing engagement of the latching means with the actuating sleeve, comprising the steps of:

(1) opening the valve by axially shifting the actuating sleeve to its valve opening position;

(2) assembling on a tubular mandrel expandable fingers, a spring pressed axially movable plunger for expanding the fingers and a radially shiftable lock retaining the spring pressed plunger in a cocked position;

(3) inserting the mandrel assemblage in the tubular conduit with the expandable fingers disposed adjacent the latching means;

(4) radially shifting the lock to release the spring pressed plunger to expand the fingers to engage the latch restraining means and move same into an inoperative position relative to the latching means, whereby the latching means engages the actuating sleeve to lock same in its valve open position.

2. The method of claim 1 further comprising the step of removing the mandrel from the tubular conduit to permit passage of wire line tools thru the locked open valve.

3. An apparatus for temporarily locking a valve mounted in a tubular conduit of a subterranean well in an open position, the valve having an axially shiftable actuating sleeve and normally inoperative latching means engagable with the actuating sleeve to hold same in its valve open position comprising: a tubular mandrel constructed and arranged for insertion within the tubular conduit and the actuating sleeve; plunger means mounted in surrounding relationship to said tubular mandrel and longitudinally movable from a first position to a second position; resilient means urging said plunger means to said second position; radially shiftable lock means holding said plunger in said first position; shiftable means mounted in surrounding relationship to said tubular mandrel adjacent to said plunger means and shiftable by axial movement of said plunger means from said first to said second position; said shiftable means being constructed and arranged when shifted to engage the latching means and shift the latching means to an operative position relative to the actuating sleeve, and means on said tubular mandrel for selectively releasing said plunger means to permit movement from said first position to said second position.

4. An apparatus according to claim 3 wherein said shiftable means is axially movable on said tubular mandrel and a spring is compressible by axial movement of said shiftable means in the same direction as the movement of said plunger means, thereby permitting removal of said mandrel assemblage from the tubular conduit after locking of the actuating sleeve in its valve open position.

5. An apparatus according to claim 3 wherein said shiftable means comprises a plurality of peripherally spaced locking dogs mounted in said tubular mandrel for radially shiftable movements with respect thereto, and an axially shiftable unlocking member in said tubular mandrel for selectively moving said locking dogs from their locking position relative to said plunger means.

6. An apparatus according to claim 4 wherein said tubular mandrel is shearably connectable to a work string and said unlocking member is directly connectable to the work string, whereby the shearing of said shearable connection between said mandrel and the work string permits said locking member to be retrieved by the work string to permit said locking dogs to shift to a releasing position relative to said plunger means.

7. An apparatus according to claim 5 or 6 further comprising a peripheral spring surrounding said locking dogs and urging said locking dogs radially inwardly relative to said mandrel.

8. An apparatus for temporarily locking a valve mounted in a tubular conduit of a subterranean well in an open position, the valve having an axially shiftable actuating sleeve and normally passive latching means located upstream of a valve head member of the valve and engagable with the actuating sleeve to hold same in its valve open position comprising: a tubular mandrel constructed and arranged for insertion within the tubular conduit and thru the actuating sleeve; plunger means mounted in surrounding relationship to said tubular mandrel and longitudinally movable from a first position to a second position; resilient means urging said plunger means to said second position; radially shiftable lock means holding said plunger in said first position; shiftable means mounted in surrounding relationship to said tubular mandrel adjacent to said plunger means and shiftable by axial movement of said plunger means from said first to said second position; said shiftable means being constructed and arranged when shifted to engage the latching means and shift the normally passive latching means downstream to an operative position relative to the actuating sleeve, and means on said tubular mandrel for selectively releasing said plunger means to permit movement from said first position to said second position.

9. A valve assembly for a fluid conduit of a subterranean well comprising, in combination; an annular housing connectable in series with the fluid conduit; a valve head pivotally mounted in said housing and shiftable from a horizontal closed position to a vertical open position disposed laterally adjacent to the bore of said annular housing; a vertically shiftable valve actuating sleeve mounted in said housing above said valve head for moving said valve head to said open position by downward movement of said actuating sleeve; a first spring pressed latching means mounted in said housing upstream of said valve head for holding said actuating sleeve in said valve opening position; a second spring pressed latching means disposed in said housing upstream of said valve head for normally holding said first spring pressed latching means in a passive position relative to said actuating sleeve; and means for shifting said second spring pressed latching means to release said first spring pressed latching means, comprising: a tubular mandrel constructed and arranged for insertion by a work string within the tubular conduit and said actuating sleeve; plunger means mounted in surrounding relationship to said tubular mandrel and longitudinally movable from a first position to a second position; resilient means urging said plunger means to said second position; radially shiftable lock means holding said plunger in said first position; shiftable means mounted in surrounding relationship to said tubular mandrel adjacent to said plunger means and shiftable by axial movement of said plunger means from said first to said second position; said means subsequent to shifting being engagable with said second spring pressed latch means to disengage same from said first spring pressed latch means; and work string actuated means for radially shifting said lock means to release said plunger to move to said second position.

10. A valve assembly for a fluid conduit of a subterranean well comprising, in combination: an annular housing connectable in series with the fluid conduit; a valve head pivotally mounted in said housing and shiftable from a horizontal closed position to a vertical open position disposed laterally adjacent the bore of said annular housing; a vertically shiftable valve head actuating sleeve mounted in said housing above said valve head for moving said valve head to said open position by downward movement of said actuating sleeve; spring pressed latching means mounted in said housing upstream of said valve head for holding said actuating sleeve in said valve opening position; a peripheral array of radially shiftable latch keys disposed in said housing upstream of said valve head for normally holding said latching means against said spring pressure in a passive position relative to said actuating sleeve; and means for radially shifting said latch keys, comprising: a tubular mandrel constructed and arranged for insertion by a work string within the tubular conduit and said actuating sleeve; plunger means mounted surrounding relationship to said tubular mandrel and longitudinally movable from a first position to a second position; resilient means urging said plunger means to said second position; radially shiftable lock means holding said plunger in said first position; shiftable means mounted in surrounding relationship to said tubular mandrel adjacent to said plunger means and shiftable by axial movement of said plunger means from said first to said second position; and work string actuated means for radially shifting said lock means to release said plunger to move to said second position; said shiftable means being constructed and arranged when expanded to engage said latch keys and release same from said latching means, thereby mechanically securing said actuating sleeve in its said valve opening position.

11. An apparatus according to claim 9 or 10 wherein said shiftable means is axially movable on said tubular mandrel and a spring is compressible by axial movement of said shiftable means in the same direction as the movement of said plunger means, thereby permitting removal of said mandrel assembly from the tubular conduit after locking of the actuating sleeve in its valve open position.

12. An apparatus according to claim 9 wherein said radially shiftable lock means comprises a plurality of peripherally spaced locking dogs mounted in said tubular mandrel for radially shiftable movements with respect thereto, and a work string shiftable unlocking member mounted within said tubular mandrel for selectively causing said locking dogs to move from their locking position relative to said plunger means.

13. An apparatus according to claim 12 wherein said tubular mandrel is shearably connected to a work string and said unlocking member is directly connected to the work string, whereby the shearing of said shearable connection between said mandrel and the work string permits said locking member to be retrieved by the work string to permit said locking dogs to shift to a releasing position relative to said plunger means.

14. An apparatus according to claims 12 or 13 further comprising a peripheral spring surrounding said locking dogs and urging said locking dogs radially inwardly relative to said mandrel.

* * * * *